US009426572B2

(12) United States Patent
Zhang et al.

(10) Patent No.: US 9,426,572 B2
(45) Date of Patent: Aug. 23, 2016

(54) PORTABLE ELECTRONIC DEVICE

(71) Applicant: Wistron Corp., New Taipei (TW)

(72) Inventors: Xu Zhang, New Taipei (TW); XiaoYong Zhang, New Taipei (TW); Shawn Xiao, New Taipei (TW)

(73) Assignee: Wistron Corp., New Taipei (TW)

( * ) Notice: Subject to any disclaimer, the term of this patent is extended or adjusted under 35 U.S.C. 154(b) by 0 days.

(21) Appl. No.: 14/495,849

(22) Filed: Sep. 24, 2014

(65) Prior Publication Data

US 2015/0319516 A1 Nov. 5, 2015

(30) Foreign Application Priority Data

May 5, 2014 (CN) ..... 2014 1 0186586

(51) Int. Cl.
*H04R 1/02* (2006.01)
*H04R 5/02* (2006.01)

(52) U.S. Cl.
CPC .. *H04R 5/02* (2013.01); *H04R 1/02* (2013.01); *H04R 2201/025* (2013.01); *H04R 2499/15* (2013.01)

(58) Field of Classification Search
CPC ..... H04R 1/02; H04R 1/023; H04R 1/025; H04R 1/26; H04R 1/2811; H04R 1/2834; H04R 1/2842; H04R 2499/11; H04R 2499/15; H04R 11/06; H04R 5/02; H04R 2205/021; G06F 1/1605; G06F 1/1632; G11B 31/00; H04M 1/03; H05K 7/14; H05K 7/12
USPC ..... 381/332–336, 89, 111, 116, 117, 118, 381/120, 150, 152, 337, 338, 339, 345, 165, 381/385, 386, 387, 388, 389, 189, 397, 423, 381/424, 425, 429, 431, 433, 124; 700/94; 361/679.11, 679.4
See application file for complete search history.

(56) References Cited

U.S. PATENT DOCUMENTS

2006/0274491 A1* 12/2006 Wangchen ..... G06F 1/1666 361/679.11
2009/0154736 A1* 6/2009 Lee ..... H04R 1/323 381/300
2010/0246874 A1* 9/2010 Chung ..... G06F 1/1681 381/334
2013/0242491 A1* 9/2013 Goldstein ..... G06F 1/16 361/679.4

OTHER PUBLICATIONS

Taiwan Patent Office, Office Action, Patent Application Serial No. 103120458, Apr. 14, 2016, Taiwan.

* cited by examiner

*Primary Examiner* — Leshui Zhang

(57) ABSTRACT

Embodiments of a portable electronic device are disclosed, the portable electronic device includes a housing, a hollow sleeve, a speaker assembly, and a keyboard module. The hollow sleeve is pivoted on the housing. The speaker assembly is movably disposed in the hollow sleeve. The keyboard module is movably disposed on the outer surface of the hollow sleeve. Through adjusting the position of the speaker assembly and the keyboard module relative to the housing, the usability of the portable electronic device is improved.

13 Claims, 11 Drawing Sheets

PORTABLE ELECTRONIC DEVICE

CROSS REFERENCE TO RELATED APPLICATIONS

This Application claims priority of China Patent Application No. 201410186586.5, filed on May 5, 2014, the entirety of which is incorporated by reference herein.

BACKGROUND OF THE INVENTION

1. Field of the Invention

The present invention relates to a portable electronic device, and more particularly to a portable electronic device in which the position of a speaker is adjustable.

2. Description of the Related Art

Modern electronic technologies develop so rapidly that various electronic devices prevail in the society. The operating functions of electronic devices are getting stronger; the processing speed grows drastically as well. Electronic devices, such as notebook computers, mobile phones, multimedia players, and personal digital assistants have become an indispensable part in people's learning, entertainment, and working lives. Their light weight, small size, convenient portability, and powerful functions appeal increasingly to the market and consumers, leading to adoption by the public.

A general portable consumer electronic product, such as a notebook computer or tablet computer, is equipped with multiple cabinets for a speaker inside its housing for providing better audio performance. However, after the speaker is mounted in the cabinet, the position of the speaker cannot be adjusted. The sound effect is decreased as the distance between the speaker and the user increases. Therefore, design of a speaker capable of adjusting its position is always desired.

BRIEF SUMMARY OF THE INVENTION

Accordingly, one objective of the present invention is to provide a portable electronic device, by changing the position of a speaker assembly and keyboard module, the usability of the electronic device is improved.

According to some embodiments of the invention, the portable electronic device includes a housing, a hollow sleeve, a speaker assembly, and a keyboard module. The sleeve is pivoted on the housing. The speaker assembly is movably telescoping in the sleeve. The keyboard module is movably disposed on an outer surface of the sleeve.

In some embodiments, the sleeve has a first end and a second end opposite to the first end. The vicinity of the first end of the sleeve is pivoted on the housing, and the second end of the housing has an opening, and the speaker assembly extends out of the sleeve via the opening.

In some embodiments, the sleeve includes an embossed structure positioned at the vicinity of the first end and configured to limit the movement of the speaker assembly when the speaker assembly moves from the second end toward the first end. In addition, the sleeve also includes a retaining structure and a connecting structure. The retaining structure is positioned at the vicinity of the second end and configured to limit the movement of the speaker assembly when the speaker assembly moves from the first end toward the second end. The connecting structure is positioned at the vicinity of the first end, and the sleeve is pivoted on the housing via the connecting structure.

In some embodiments, the speaker assembly includes a first chamber, a second chamber, and a speaker unit. The first chamber is movably telescoping in the sleeve. The second chamber connects to the first chamber. An included angle, such as 90 degrees, is formed between the first chamber and the second chamber. The speaker unit is disposed in the first chamber and the second chamber. In some other embodiments, the portable electronic device includes two sleeves respectively pivoted on the two opposite sides of the housing. The speaker assembly includes two first chambers connecting to two opposite ends of the second chamber, and each of the two first chambers telescopes into one of the two sleeves in a movable manner. Moreover, the first chamber has a recess structure, and the sleeve includes a guiding structure corresponding to the recess structure. The movement of each first chamber in the sleeve is guided by the guiding structure.

In some embodiments, the portable electronic device includes a clipping assembly and a rail assembly. The keyboard module is detachably connected to the clipping assembly. The rail assembly is disposed on the outer surface of the sleeve to facilitate the movement of the keyboard module and the clipping assembly. The clipping assembly includes a pushing member configured to hold the keyboard module, and an adjusting member configured to facilitate an adjustment to the holding distance of the clipping assembly.

The keyboard module and the clipping assembly are able to be moved relative to the housing. In some embodiments, the rail assembly includes a railway, an extending member, and a sliding stage. The extending member is movably disposed on the railway via the sliding stage. The extending member includes a groove, and the clipping assembly is disposed on the extending member via the groove and movable along the groove. The sliding stage includes a supporting substrate and a plurality of rolling balls disposed on the supporting substrate. Each of the rolling balls is in contact with the railway and the extending member simultaneously.

In some embodiments, the speaker assembly and the keyboard module are arranged to move along the length direction of the sleeve.

BRIEF DESCRIPTION OF THE DRAWINGS

For a more complete understanding of the embodiments, and the advantages thereof, reference is now made to the following descriptions taken in conjunction with the accompanying drawings.

DETAILED DESCRIPTION OF THE ILLUSTRATIVE EMBODIMENTS

The making and using of the embodiments of the disclosure are discussed in detail below. It should be appreciated, however, that the embodiments can be embodied in a wide variety of specific contexts. The specific embodiments discussed are merely illustrative, and do not limit the scope of the disclosure.

Figure 1:
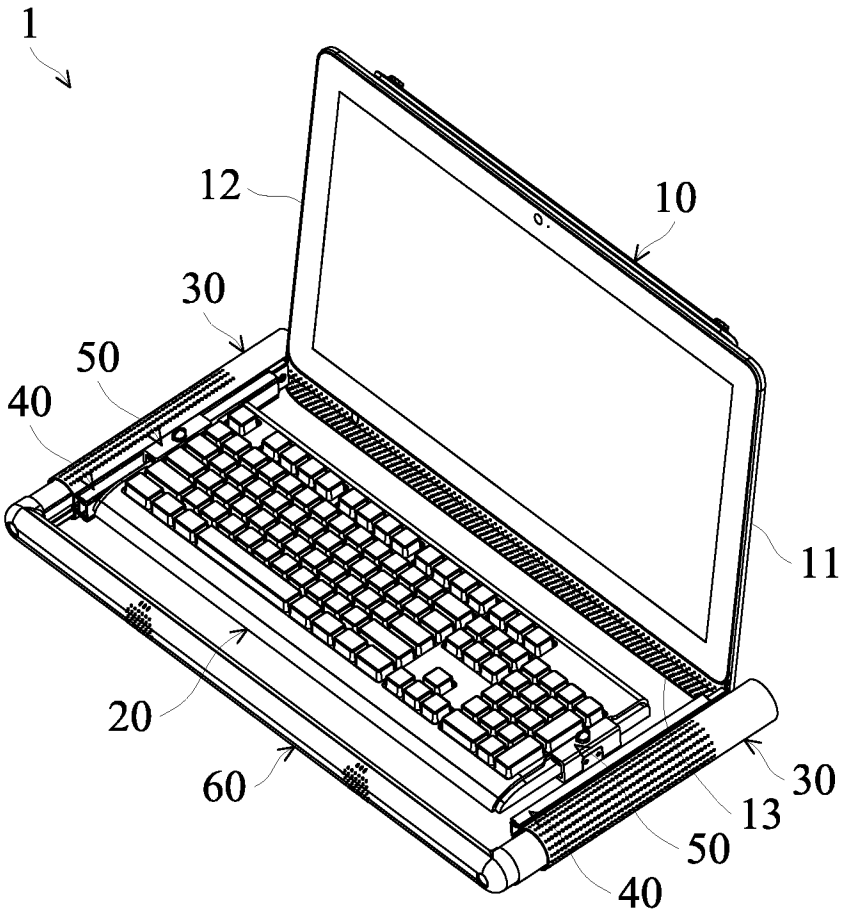
FIG. 1 shows a schematic diagram of a portable electronic device, in accordance with some embodiments.

Referring to FIG. 1, the portable electronic device 1 includes a housing 10, a keyboard module 20, two sleeves 30, two rail assemblies 40, two clipping assemblies 50, and a speaker assembly 60, in accordance with some embodiments. The two sleeves 30 respectively pivot on two lateral surfaces 11 and 12 of the housing 10 close to a bottom surface 13. Each rail assembly 40 is disposed on one of the sleeves 30. The two clipping assemblies 50 cooperatively hold the keyboard module 20 and are respectively connected to the sleeve 30 via the two rail assemblies 40. The speaker assembly 60 is connected to the housing 10 via the two sleeves 30. By changing the position of the keyboard module 20 and the speaker assembly 60 relative to the housing 10, the portable electronic device 1 is operated in multiple different modes.

Figure 2:
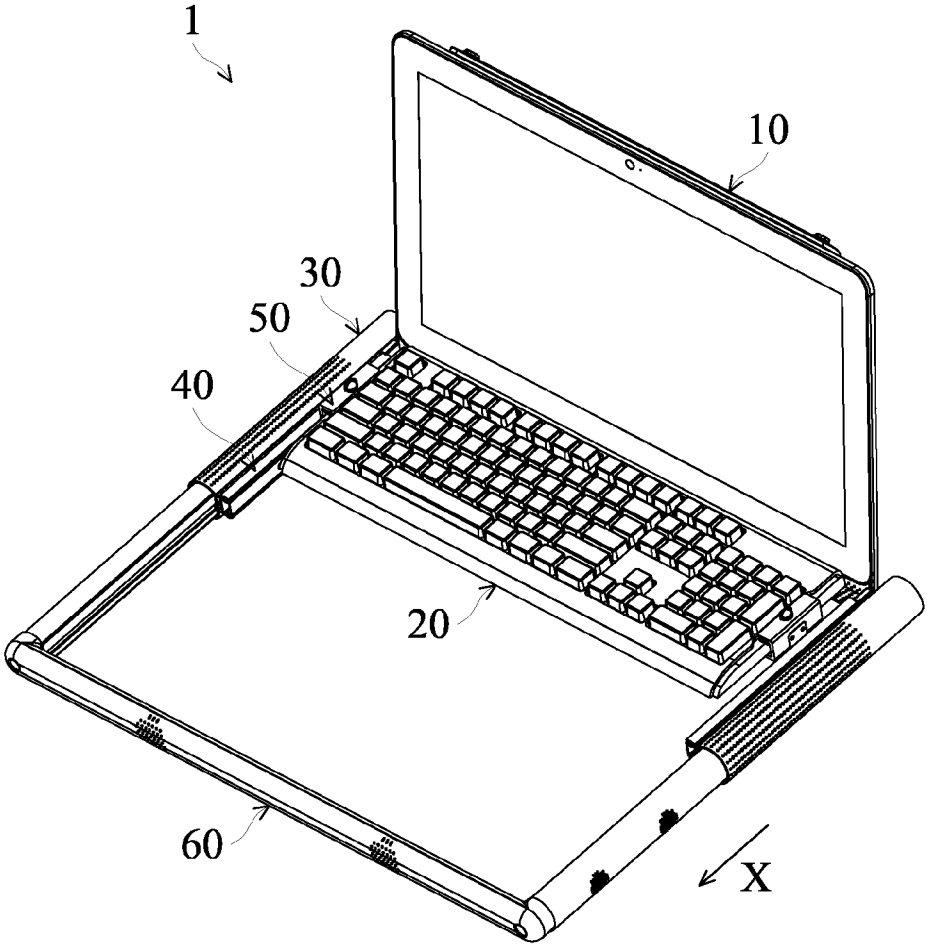
FIG. 2 shows a schematic diagram of a portable electronic device, in accordance with some embodiments.
Figure 3:
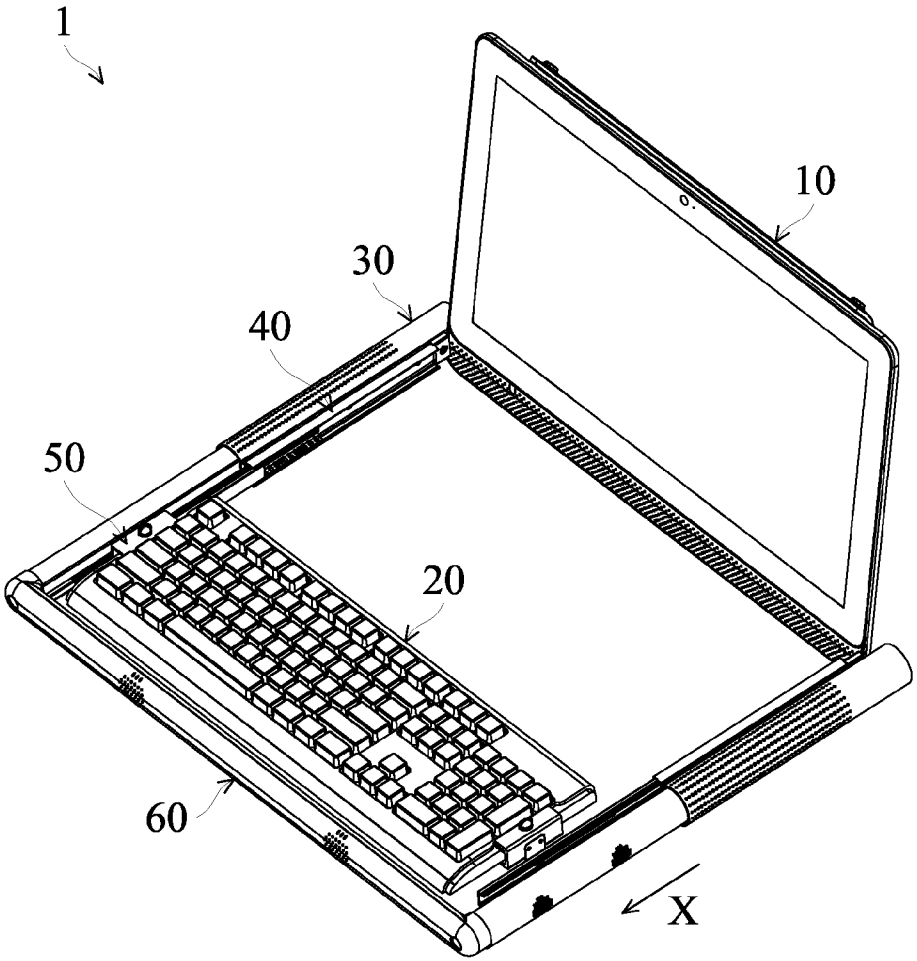
FIG. 3 shows a schematic diagram of a portable electronic device, in accordance with some embodiments.

For example, as shown in FIG. 1, two side portions of the speaker assembly 60 are received in the two sleeves 30, and the keyboard module 20 is positioned between the two sleeves 30. Alternatively, as shown in FIG. 2, the speaker assembly 60 is stretched out of the two sleeves 30 by moving along the length (in the X-axis direction) of each sleeve 30. Alternatively, as shown in FIG. 3, the speaker assembly 60 is stretched out of the two sleeves 30 by moving along the length direction of each sleeve 30, and the keyboard module 20 is moved away from the two sleeves 30 along the length direction of each sleeve 30 as well.

Figure 4:
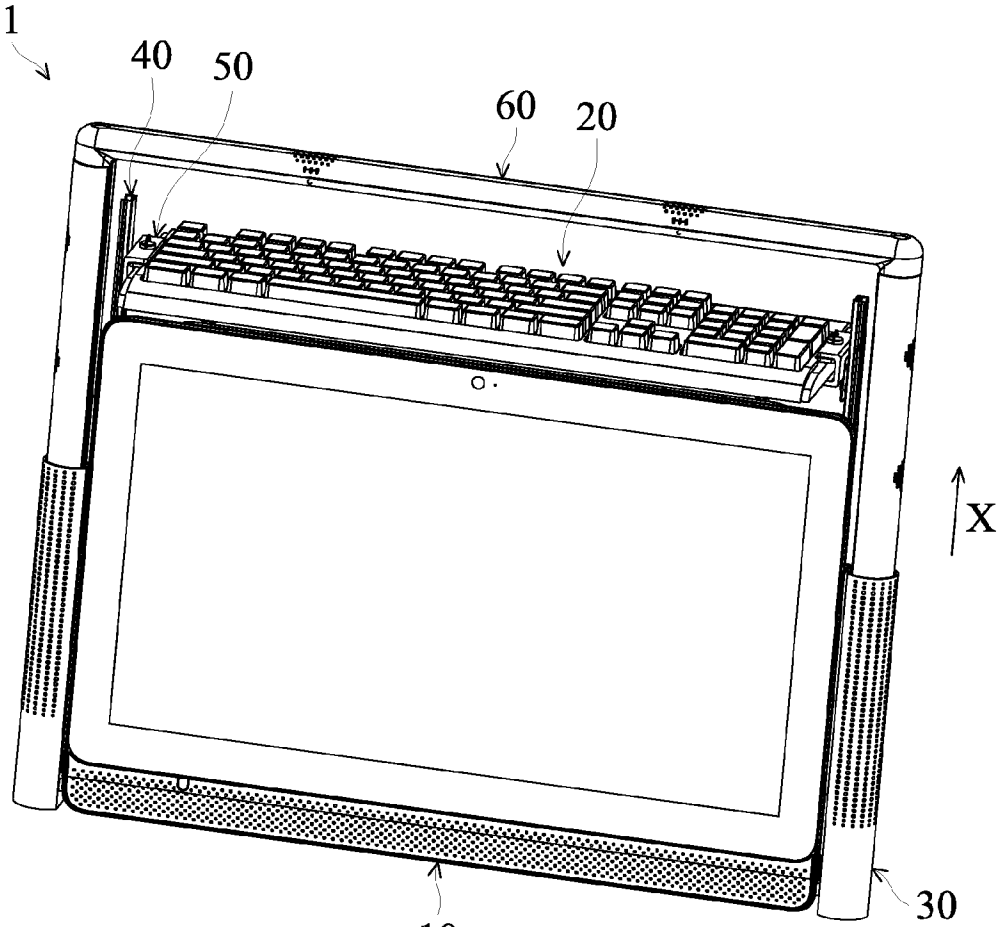
FIG. 4 shows a schematic diagram of a portable electronic device, in accordance with some embodiments.

Alternatively, as shown in FIG. 4, the speaker assembly 60 is stretched out of the two sleeves 30 by moving along the length direction of each sleeve 30, and the keyboard module 20 is moved away from the two sleeves 30 along the length direction of each sleeve 30, and the two sleeves 30 pivot about the housing 10 such that the keyboard module 20 and speaker assembly 60 are positioned at the upper side of the housing 10.

Figure 5:
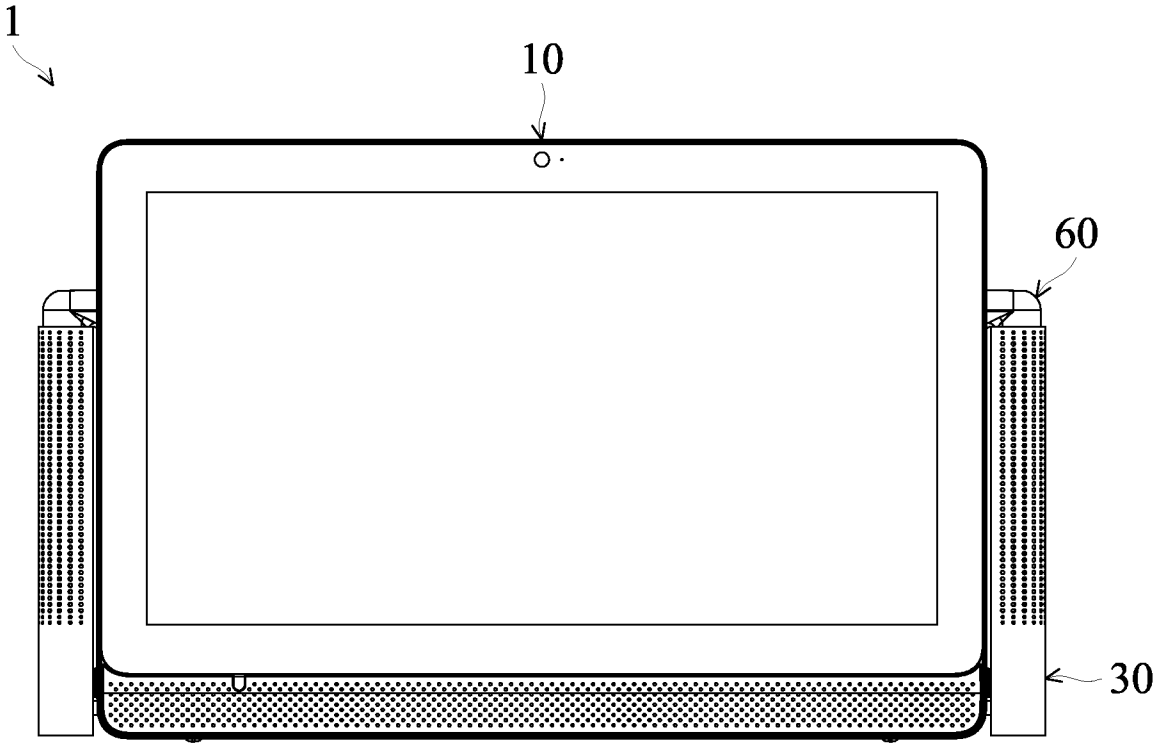
FIG. 5 shows a schematic diagram of a portable electronic device, in accordance with some embodiments.

Alternatively, as shown in FIG. 5, the speaker assembly 60 is received in the two sleeves 30, and the keyboard module 20 is positioned between the two sleeves 30, and the two sleeves 30 pivot about the housing 10 such that the keyboard module 20 and speaker assembly 60 are positioned behind the housing 10. In some embodiments, the keyboard module 20 is selectively removed from the portable electronic device 1, so as to decrease the weight of the portable electronic device 1.

Figure 6:
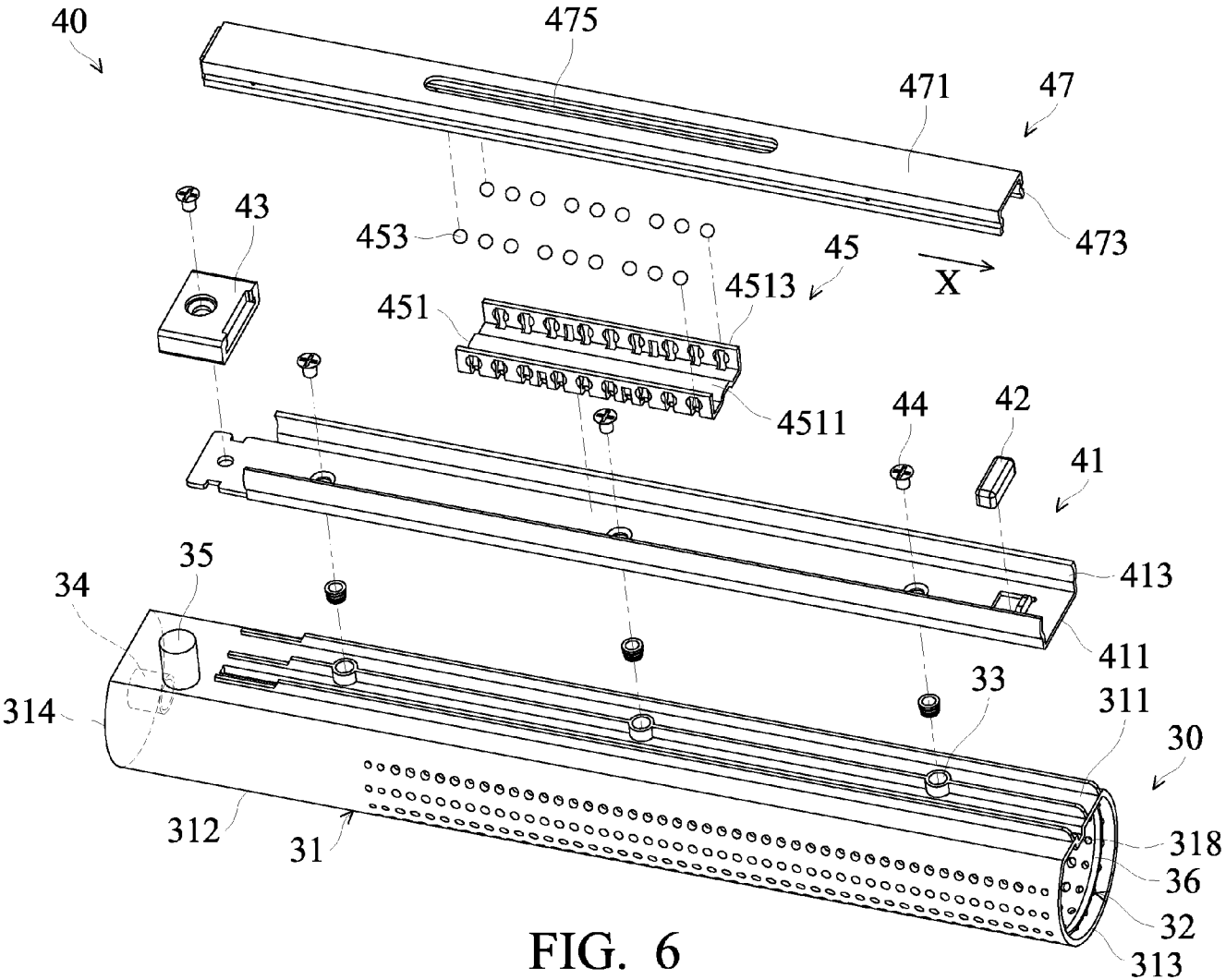
FIG. 6 shows an exploded view of partial elements of the portable electronic device, in accordance with some embodiments.

The structural features of the portable electronic device 1 are described hereinafter:

Referring to FIG. 6, in some embodiments, each of the two sleeves 30 includes a main body 31, a number of fixing elements 33, an embossed structure 34, a connecting structure 35, a retaining structure 36, and a guiding structure 38. The main body 31 is a hollowed structure. A first end 314 of the main body 31 is a closed end, and a second end of the main body 31 is opened. An opening 32 is formed on the second end 313 of the main body 31. The main body 31 has a bottom portion 311 and an arc-shaped upper portion 312. The fixing elements 33 are formed on the outer surface of the bottom portion 311. The guiding structure 318 is formed on an inner surface of the bottom portion 311. The guiding structure 318 extends from the second end 313 of the main body 31 to the first end of the main body 31. The connecting structure 35, such as a hinge, is disposed at the vicinity of the first end 314 of the main body 34. Each of the two sleeves 30 is connected to the housing 10 (not shown in FIG. 6) via the connecting structure 35.

The embossed structure 34 protrudes towards the second end 313 from the first end 314 of the main body 31 and terminates at its end portion. The end portion of the embossed structure 34 is closer to the second end 313 of the main body 31 than the connecting structure 35. The retaining structure 36 is positioned at the vicinity of the second end 313 of the main body 31 and protruded from the inner surface of the main body 31. The retaining structure 36 may entirely circle the inner surface of the main body 31 or partially circle the inner surface of the main body 31. The functions of the embossed structure 34 and the retaining structure 36 are described in the description referring to FIG. 9.

Still referring FIG. 6, in some embodiments, each of the two rail assemblies 40 includes a railway 41, a first stop element 42, a second stop element 43, a number of screws 44, a sliding stage 45, and an extending member 47. The railway 41 has a bottom portion 411 and two lateral portions 413 connected to two sides of the bottom portion 411. A number of positioning holes are formed on the bottom portion 411 to allow the screws 44 to pass therethrough. The first stop element 42 is positioned at the vicinity of the second end 313 of the main body 31. The second stop element 43 is positioned at the vicinity of the first end 314 of the main body 31 and fixed at the railway 41. The first stop element 42 and the second stop element 43 may be made of flexible material, such as rubber. The functions of the first stop element 42 and a second stop element 43 will be described in the description referring to FIGS. 7A and 7B.

The sliding stage 45 includes a supporting substrate 451 and a number of rolling balls 453. The supporting substrate 451 has a bottom portion 4511 and two lateral portions 4513 connecting to two sides of the bottom portion 4511. The rolling balls 453 are disposed in through holes formed on the two lateral portions 4513. The extending member 47 has a top portion 471 and two lateral side walls 473 connected to two sides of the top portion 471. A groove 475 is formed on the top portion 471. The groove 475 is positioned at the substantial central region of the top portion 471 and extends along the length direction (X-axis direction) of the corresponding sleeve 30.

In some embodiments, to assembly one of the two rail assemblies 40, the first stop element 42 is firstly fixed at the railway 41. Afterwards, the screws 44 are used to affix the railway 41 to the bottom portion 311 of the corresponding sleeve 30. Afterwards, the sliding stage 45 is mounted on the railway 41, such that the rolling balls 453 of the sliding stage 45 are abutted by the lateral portion 413 of the railway 41. Afterwards, the extending member 47 is mounted on the sliding stage 45, such that the rolling balls 453 of the sliding stage 45 are abutted by the lateral side walls 473 of the extending member 47. Since the rolling balls 453 are abutted by the lateral portion 413 of the railway 41 and the lateral side walls 473 of the extending member 47, the extending member 47 is arranged sliding along the length direction of the corresponding sleeve 30 relative to the sliding stage 45. In addition, the sliding stage 45 is arranged sliding along the length direction of each sleeve 30 relative to the railway 41. Afterwards, the second stop element 43 is mounted, and the assembly process of the rail assembly 40 is completed.

Figure 7A:
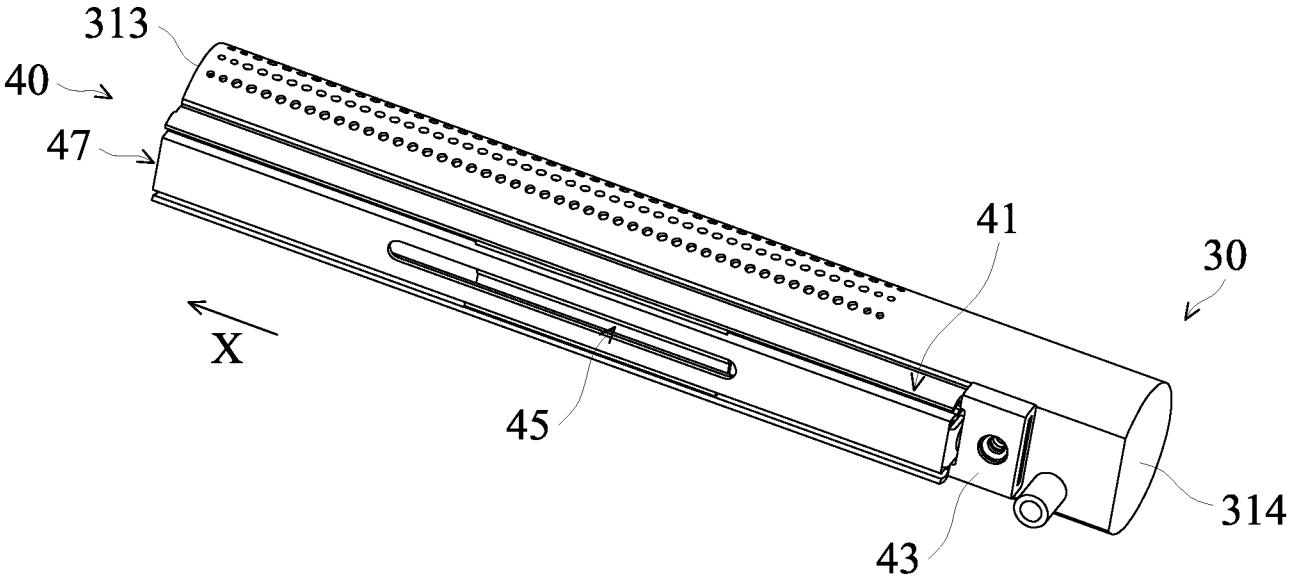
FIG. 7A shows a schematic diagram of partial elements of a portable electronic device, in accordance with some embodiments, wherein a rail assembly is at a storage mode.
Figure 7B:
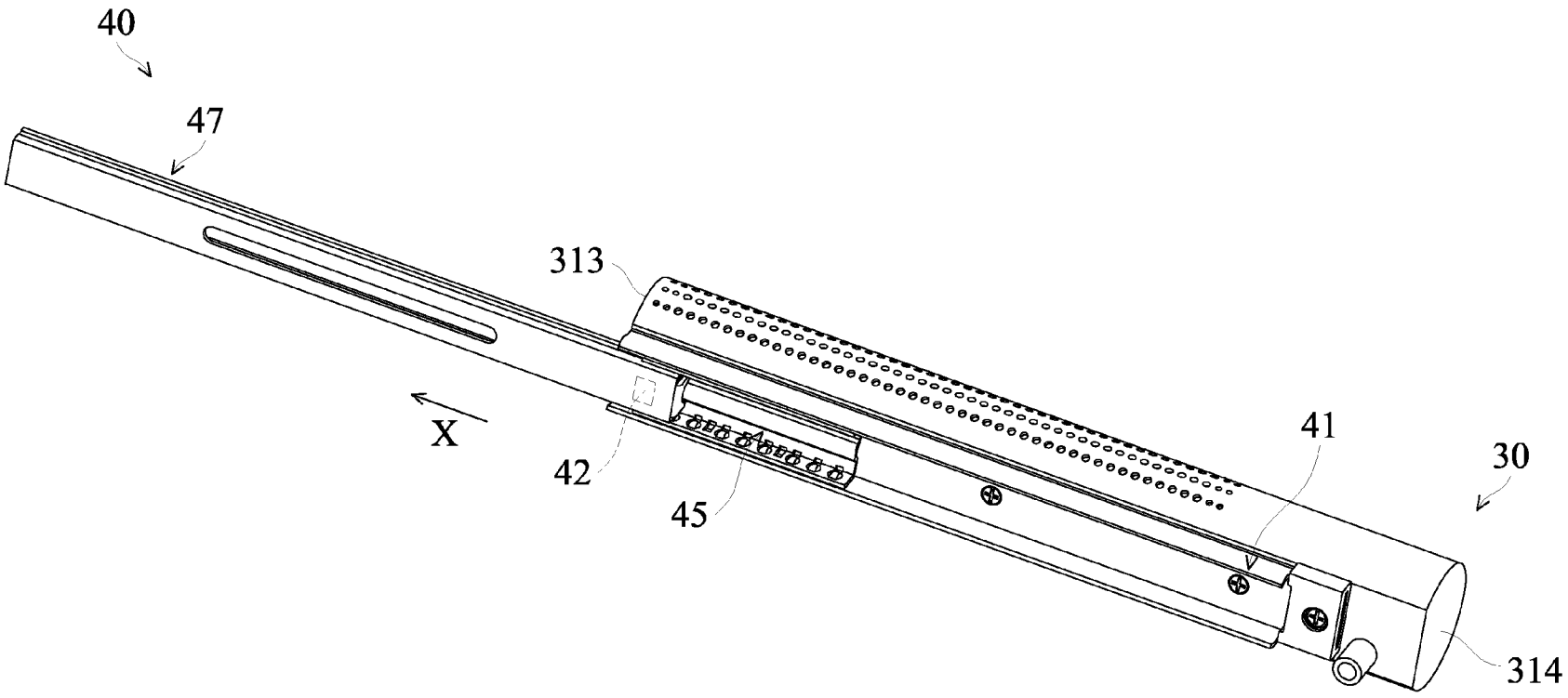
FIG. 7B shows a schematic diagram of partial elements of a portable electronic device, in accordance with some embodiments, wherein a rail assembly is at a stretched mode.

Referring to FIGS. 7A and 7B, in some embodiments, the operational method of the two rail assemblies 40 is described as follows:

As shown in FIG. 7A, when the two rail assemblies 40 are in a storage mode, one end of each extending member 47 abuts the corresponding second stop element 43, and the other end of each extending member 47 is aligned with the corresponding second end 313 of the sleeve 30. As shown in FIG. 7B, when the two rail assemblies 40 are pushed by an external force to move along a direction parallel to the length of the corresponding sleeve 30, the two rail assemblies 40 are transferred from the storage mode to an extended mode. Specifically, as an external force is applied, each extending member 47 is slid toward a direction away from the first end 314 of the corresponding sleeve 40 so as to drive the corresponding sliding stage 45 to slide toward the direction away from the first end 314 of the sleeve 30. The two sliding stages 45 are kept moving until they are stopped by the second stop elements 43.

Figure 8:
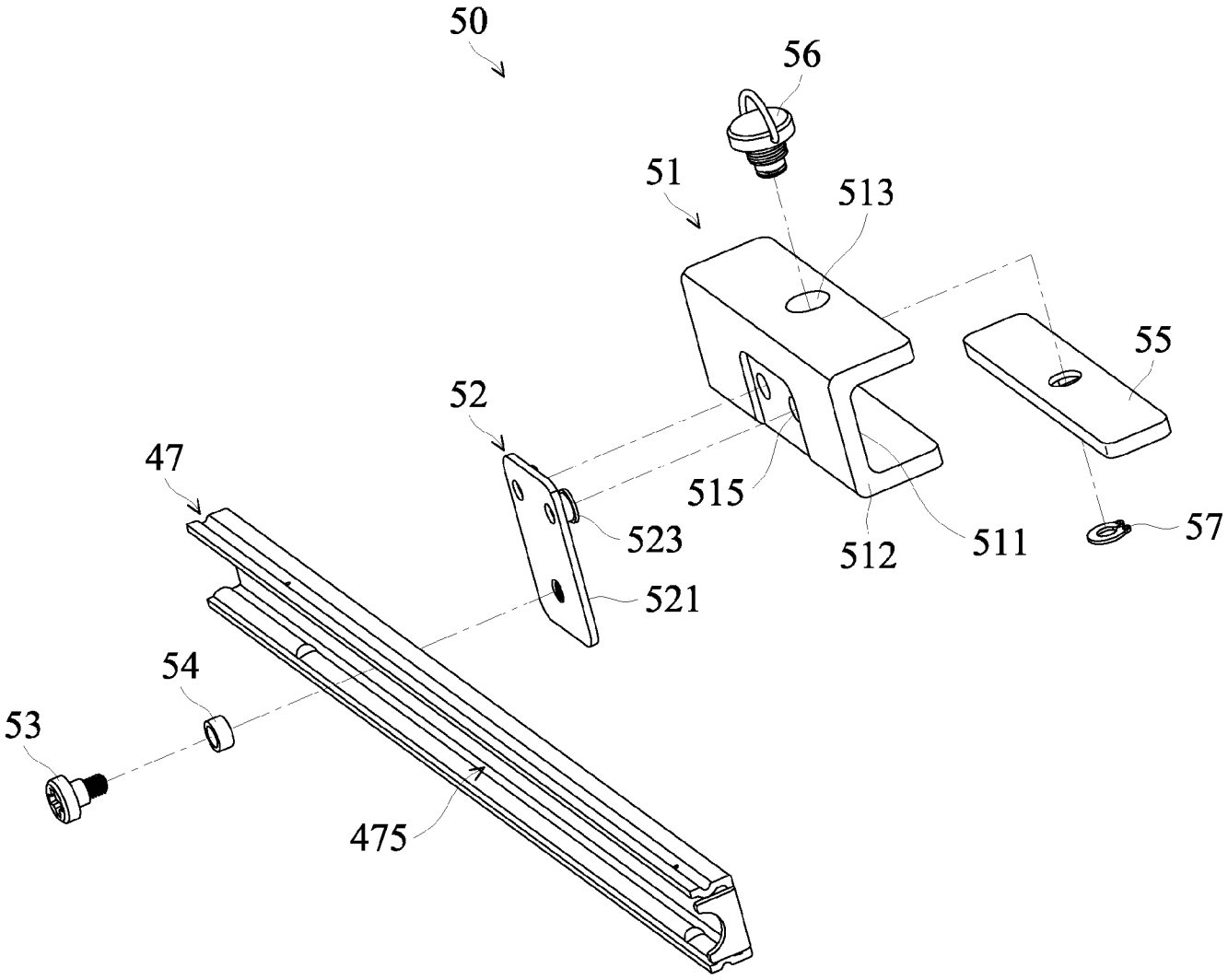
FIG. 8 shows an exploded view of partial elements of the portable electronic device, in accordance with some embodiments.

Referring to FIG. 8, in some embodiments, each of the two clipping assemblies 50 includes a clipping member 51, a seat 52, a screw 53, a ring 54, a pushing member 55, an adjusting member 56, and an elastic element 57. The clipping member 51 has an U-shaped configuration and includes a side portion 511, a lower portion 512, and an upper portion 513. The lower portion 512 and the upper portion 513 are respectively connected to the lower side and the upper side of the side portion 511. The pushing member 55 is disposed at the inner side of the upper portion 513. The adjusting member 56 passes through the upper portion 513 and the pushing member 55 and is connected the elastic element 57. By rotating the adjusting member 56, a holding distance between the pushing member 55 and the lower portion 512 is adjusted. Therefore, the clipping member 51 is able to hold the keyboard module 20 (not shown in FIG. 8) with different specifications.

The seat 52 includes a plate-shaped structure 521 and one or more fixing portions 523 corresponding to the through holes 515. The fixing portions 523 of the seat 52 are fixed at the through holes 515 of the clipping member 51 by suitable means, such as thermal melting adhesive. The ring 54 is made of elastic material such a rubber. The ring 54 is disposed in the groove 475 in a tight fit manner and deformed due to the compression of the groove 475. The screw 53 passes through the ring 54 and the groove 475 of the extending member 47 and is fixed at the plate-shaped structure 521 by a screwing arrangement. Since the ring 54 connects the clipping assembly 50 to the extending member 47, the clipping assembly 50 is able to slide along the groove 475 or rotate relative to the extending member 47. It is noted that since the ring 54 is disposed in the groove 475 in a tight fit manner, the clipping assembly 50 remains stationary relative to the extending member 47 while no external force is applied.

Figure 9:
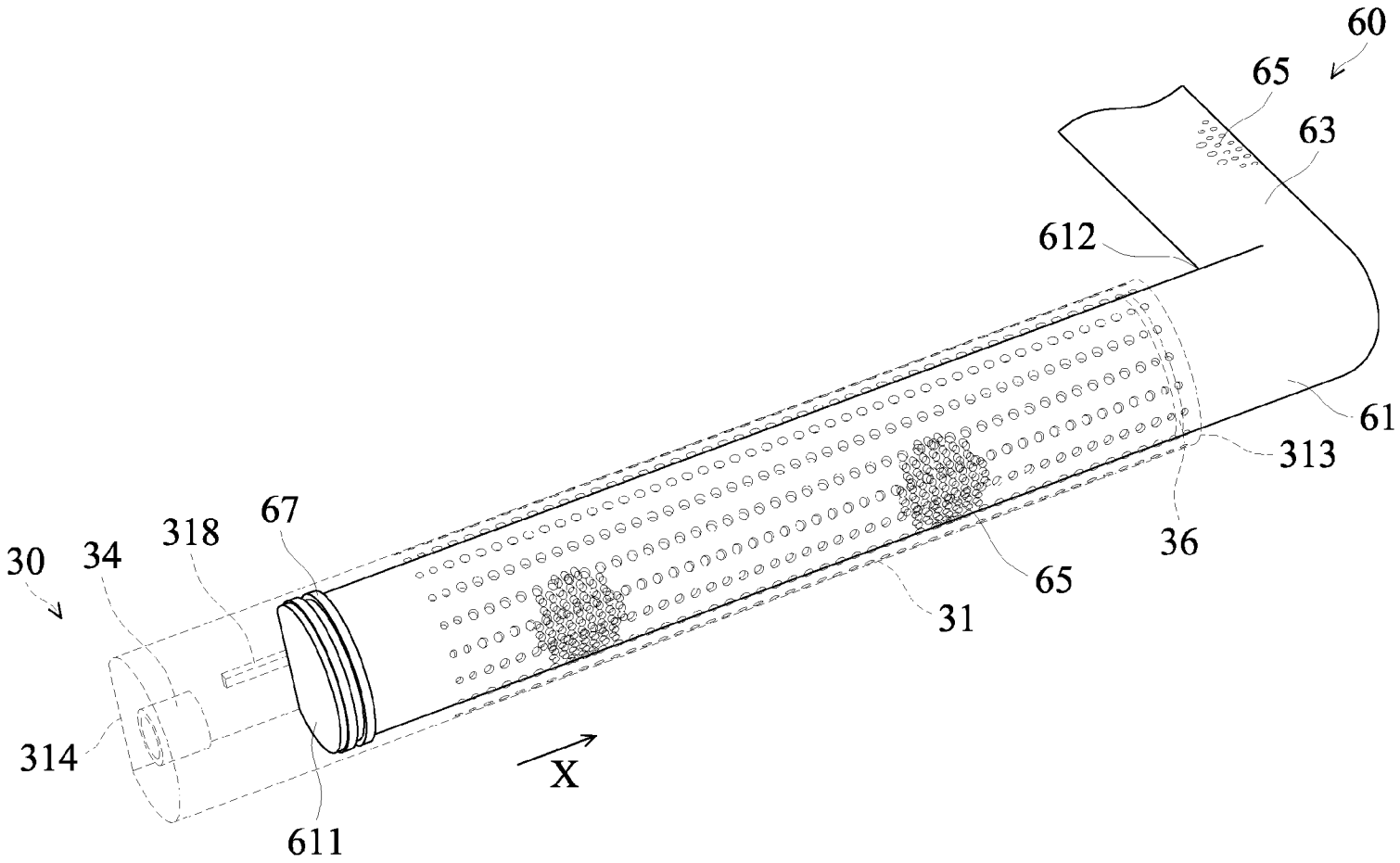
FIG. 9 shows a schematic diagram of partial elements of a portable electronic device, in accordance with some embodiments.

Referring to FIG. 9, in some embodiments, the speaker assembly 60 includes two first chambers 61 (only one first chamber 61 is shown in FIG. 9), a second chamber 63, a number of speakers 65, and a number of positioning rings 67. Each first chamber 61 has a first end 611 and a second end 612. The second chamber 63 is connected between the two second ends 612 of the two first chambers 61. The second chamber 63 is connected to the first chambers 61 by a suitable means such as a screw arrangement. The first chambers 61 and the second chamber 63 may be hollowed structure, and the speakers 65 are disposed in the first chambers 61 and the second chamber 63.

Figure 10:
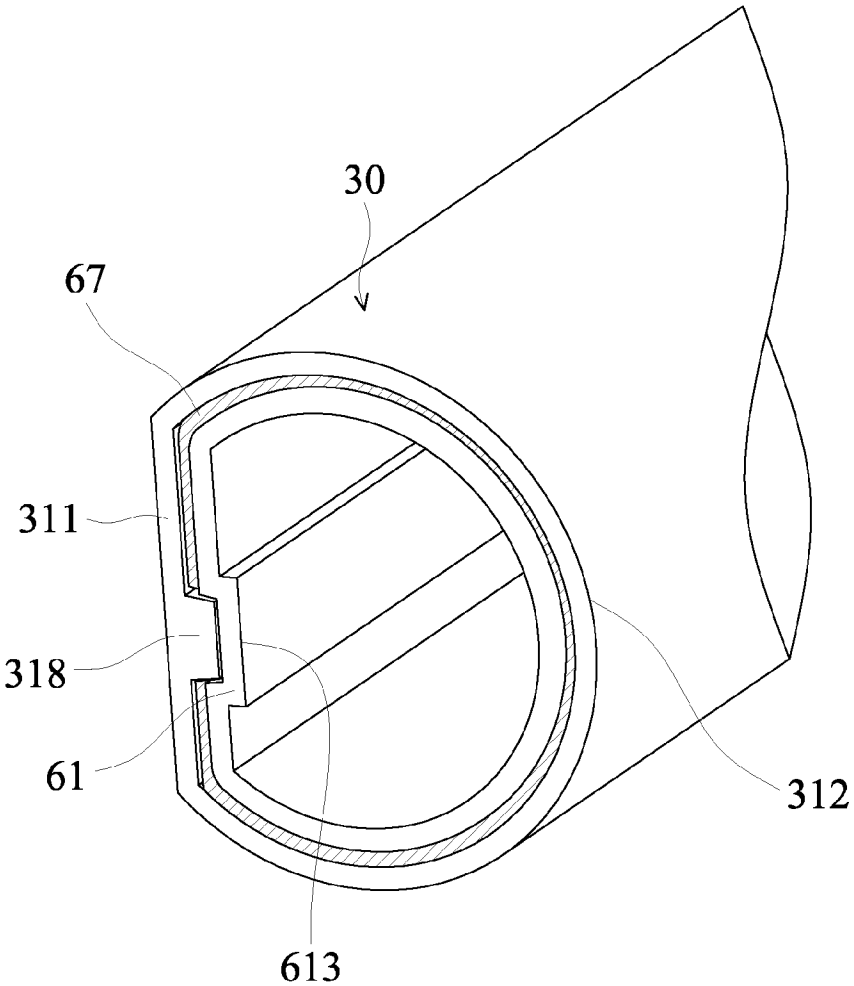
FIG. 10 shows a cross-sectional view of partial elements of a portable electronic device, in accordance with some embodiments.

As shown in FIG. 10, each of the two first chambers 61 has a recess structure 613. The recess structure 613 is connected to the guiding structure 318 of the corresponding sleeve 30. When the two first chambers 61 are respectively moved in the two sleeves 30, the two first chambers 61 are guided by the corresponding guiding structures 318. A positioning ring 67 is positioned at the vicinity of the first end 611 of each first chamber 61 (FIG. 9) and formed on the outer surface of each first chamber 61 where the recess structure 613 is not formed. Through the friction force between the positioning rings 67 and the inner surface of the two sleeves 30, the two first chambers 61 remain stationary relative to the two sleeves 30.

Referring again to FIG. 9, each of the two first chambers 61 of the speaker assembly 60 is able to be moved along the length direction of the corresponding sleeve 30. It should be noted that when the first chamber 61 moves from the first end 314 toward the second end 313 of the corresponding sleeve 30, the movement of the first chamber 61 is limited by the retaining structure 36. Specifically, when the first chamber 61 moves toward the outside of the sleeve 30, the movement of the first chamber 61 is stopped by the engagement of the positioning ring 67 and the retaining structure 36, so that the first chamber 61 is prevented from being separated from the corresponding sleeve 30. On the other hand, the movement of the first chamber 61 is limited by the embossed structure 34, when the first chamber 61 moves from the second end 313 toward the first end 314. Specifically, when the first chamber 61 moves toward the inside of the sleeve 30, the movement of the first chamber 61 is stopped by the engagement of a first end 611 of the first chamber 61 and the retaining structure 36, so that the first chamber 61 is prevented from approaching the first end 314, and damage to the connecting structure 35 due to collection is avoided.

According to the above descriptions, the portable electronic device of the embodiments of the invention have the following advantages. For example, according to user demand, the portable electronic device is able to perform a variety of sound-effect functions by changing the position of the speaker. In addition, the user is able to work more efficiently by changing the position of the keyboard module. Moreover, by changing the positioned angle of the sleeve and selectively detaching the keyboard module, the portable electronic device has improved portability and ease of use.

While the invention has been described by way of example and in terms of preferred embodiment, it is to be understood that the invention is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A portable electronic device, comprising:

a housing;

a sleeve, having a hollowed structure and pivoted on the housing;

a speaker assembly, movably telescoping in the sleeve; and a keyboard module, movably disposed on an outer surface of the sleeve;

wherein the sleeve is pivotable relative to the housing about an axis, and a length direction of the sleeve is perpendicular to the axis;

wherein the speaker assembly and the keyboard module are movably connected to the sleeve such that the speaker assembly and the keyboard module are movable along the length direction of the sleeve.

2. The portable electronic device as claimed in claim 1, wherein the sleeve has a first end and a second end opposite to the first end, the vicinity of the first end of the sleeve is pivoted on the housing, and the second end of the sleeve has an opening, with the speaker assembly extending out of the sleeve via the opening.

3. The portable electronic device as claimed in claim 2, wherein the sleeve comprises an embossed structure, and the embossed structure is positioned at the vicinity of the first end and configured to limit the movement of the speaker assembly when the speaker assembly moves from the second end toward the first end.

4. The portable electronic device as claimed in claim 2, wherein the sleeve comprises a retaining structure, the retaining structure is positioned at the vicinity of the second end and configured to limit the movement of the speaker assembly when the speaker assembly moves from the first end toward the second end.

5. The portable electronic device as claimed in claim 2, wherein the sleeve comprises a connecting structure, the connecting structure is positioned at the vicinity of the first end, and the sleeve is pivoted on the housing via the connecting structure.

6. The portable electronic device as claimed in claim 1, wherein the speaker assembly comprises:

a first chamber, movably telescoping in the sleeve;

a second chamber, connecting to the first chamber, wherein an included angle is formed between the first chamber and the second chamber; and a speaker unit, disposed in the first chamber and the second chamber.

7. The portable electronic device as claimed in claim 6, comprising two sleeves, the two sleeves are respectively pivoted on two opposite sides of the housing, wherein the speaker assembly comprises two first chambers that connect to two opposite ends of the second chamber, and each of the two first chambers telescopes in one of the two sleeves.

8. The portable electronic device as claimed in claim 7, wherein the first chamber has a recess structure, and the sleeve comprises a guiding structure connected to the recess structure, wherein the movement of the first chamber is guided by the guiding structure.

9. The portable electronic device as claimed in claim 1, further comprising:

a clipping assembly, wherein the keyboard module is detachably connected to the clipping assembly; and a rail assembly, disposed on the outer surface of the sleeve to facilitate the movement of the keyboard module and the clipping assembly.

10. The portable electronic device as claimed in claim 9, wherein the rail assembly comprises:

a railway; and an extending member, movably disposed on the railway, wherein the extending member comprises a groove, and the clipping assembly is disposed on the extending member via the groove and movable along the groove.

11. The portable electronic device as claimed in claim 10, wherein the rail assembly further comprises a sliding stage, the extending member is disposed on the railway via the sliding stage, wherein the sliding stage comprises a supporting substrate and a plurality of rolling balls disposed on the supporting substrate, and each of the rolling balls is in contact with the railway and the extending member simultaneously.

12. The portable electronic device as claimed in claim 9, wherein the clipping assembly further comprises a pushing member configured to hold the keyboard module and an adjusting member configured to facilitate an adjustment of a holding distance of the clipping assembly.

13. The portable electronic device as claimed in claim 1, wherein the speaker assembly and the keyboard module are arranged to move along a length direction of the sleeve.

* * * * *